US009628882B2

(12) United States Patent
Bae et al.

(10) Patent No.: US 9,628,882 B2
(45) Date of Patent: Apr. 18, 2017

(54) SOUND APPARATUS

(71) Applicant: LG ELECTRONICS INC., Seoul (KR)

(72) Inventors: Joonsub Bae, Seoul (KR); Jaejun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 451 days.

(21) Appl. No.: 14/164,894

(22) Filed: Jan. 27, 2014

(65) Prior Publication Data

US 2014/0334660 A1 Nov. 13, 2014

(30) Foreign Application Priority Data

May 9, 2013 (KR) ..... 10-2013-0052399

(51) Int. Cl.
*H04R 1/02* (2006.01)

(52) U.S. Cl.
CPC ..... *H04R 1/026* (2013.01)

(58) Field of Classification Search
CPC ..... H04R 1/02; H04R 1/026; H04R 1/028; H04N 5/64; H04N 5/655; H04N 5/642; F16B 5/0233; F16M 11/08; F16M 11/24; B66F 2700/123; H04B 1/08; A47B 81/067; G11B 33/022
See application file for complete search history.

(56) References Cited

U.S. PATENT DOCUMENTS 6,997,525 B2 * 2/2006 Gillengerten ..... H04N 5/642 312/21
2003/0197110 A1 * 10/2003 Cui ..... B25J 9/1065 248/585
2005/0185801 A1 * 8/2005 McCarty ..... H04N 5/64 381/87

(Continued)

FOREIGN PATENT DOCUMENTS

KR 10-2001-0098198 A 11/2001
KR 10-2004-0080096 A 9/2004

(Continued)

OTHER PUBLICATIONS

Korean Notice of Allowance dated May 20, 2014 issued in Application No. 10-2013-0052399 (with English translation).

*Primary Examiner* — Duc Nguyen
*Assistant Examiner* — Taunya McCarty
(74) *Attorney, Agent, or Firm* — KED & Associates, LLP

(57) ABSTRACT

A sound apparatus is disclosed. The sound apparatus includes a body, a bracket coupled to a lower portion of a rear surface of the body, a plurality of upper links, one end of each of the upper links being hinge-coupled to the bracket, a middle frame hinge-coupled to the other end of each of the upper links, a plurality of lower links, one end of each of the lower links being hinge-coupled to the middle frame, and at least one speaker module hinge-coupled to the other end of each of the lower links to vertically move according to rotational movement of the upper links and the lower links, wherein a direction of rotation of the upper link is opposite to a direction of rotation of the lower links, and the middle frame moves in a lateral direction during the rotational movement of the upper links and the lower links.

17 Claims, 16 Drawing Sheets

(56) References Cited

U.S. PATENT DOCUMENTS

| | | | | |
|---|---|---|---|---|
| 2007/0188056 | A1* | 8/2007 | Chang | A47B 81/064 312/7.2 |
| 2010/0104124 | A1* | 4/2010 | Abraham | H04R 1/028 381/333 |
| 2010/0183186 | A1* | 7/2010 | Noguchi | H04N 5/642 381/388 |
| 2012/0189420 | A1* | 7/2012 | Kemper | H04R 1/026 414/800 |

FOREIGN PATENT DOCUMENTS

| | | | |
|---|---|---|---|
| KR | 10-0710811 | B1 | 7/2007 |
| KR | 10-1164190 | B1 | 7/2012 |

* cited by examiner

SOUND APPARATUS

CROSS-REFERENCE TO RELATED APPLICATION

Pursuant to 35 U.S.C. §119(a), this application claims the benefit of the Korean Patent Application No. 10-2013-0052399, filed on May 9, 2013, which is hereby incorporated by reference as if fully set forth herein.

BACKGROUND OF THE INVENTION

Field of the Invention

The present invention relates to a sound apparatus including a speaker module which vertically moves and is exposed at the front only when used.

Discussion of the Related Art

Sound apparatuses refer to devices including a speaker that radiates sound waves by converting an electric signal into vibration of a diaphragm to generate waves of condensation and rarefaction in the air. A display apparatus such as a large-size TV, which is equipped with a speaker as an essential constituent, has become one of sound apparatuses.

As slim TVs with a large screen have recently come into widespread use, importance of design of a neat front has increased. As such, speaker modules are now commonly installed so as not to be visible from the front of the TVs. Disposing the speaker at the side may decrease efficiency of transfer of sound to viewers, thereby resulting in performance degradation.

SUMMARY OF THE INVENTION

Accordingly, the present invention is directed to a sound apparatus that substantially obviates one or more problems due to limitations and disadvantages of the related art.

An object of the present invention is to provide a sound apparatus including a speaker module which vertically moves and is exposed at the front only when used.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a sound apparatus provided with a speaker vertically movable at a lower side includes a body, a bracket coupled to a lower portion of a rear surface of the body, a plurality of upper links, one end of each of the upper links being hinge-coupled to the bracket, a middle frame hinge-coupled to the other end of each of the upper links, a plurality of lower links, one end of each of the lower links being hinge-coupled to the middle frame, and at least one speaker module hinge-coupled to the other end of each of the lower links to vertically move according to rotational movement of the upper links and the lower links, wherein a direction of rotation of the upper link is opposite to a direction of rotation of the lower links, and the middle frame moves in a lateral direction during the rotational movement of the upper links and the lower links.

The sound apparatus may further include a first hinge gear coupled to the other end of each of the upper links and a second hinge gear coupled to the one end of each of the lower links, the first hinge gear and the second hinge gear rotating in engagement with each other t during rotation of the upper links and the lower links.

The sound apparatus may further include a damper adjoining at least one end of each of the upper links or the lower links to apply frictional force to reduce a rotational speed of the upper links and the lower links.

The sound apparatus may further include a guide to guide linear movement of the speaker module when the speaker module vertically moves.

The bracket may include a first bracket coupled to the rear surface of the body, and a second bracket protruding from an upper portion of the first bracket toward the rear surface of the body, wherein the guide may be a guide pole placed between the second bracket and an upper end of the speaker module, a length of the guide pole being variable.

The guide may include a vertical guide groove formed in the rear surface of the body or the bracket, and a guide protrusion protruding from an upper portion of the speaker module, the guide protrusion being inserted into the guide groove to move when the speaker module vertically moves.

The bracket may include a first bracket coupled to the rear surface of the body.

a second bracket protruding from an upper portion of the first bracket toward the rear surface of the body, a first coupling unit formed at the second bracket, and a second coupling unit positioned at an upper end of the speaker module, the second coupling unit being fastened to the first coupling unit when the speaker module moves upward and being released from the first coupling unit when the speaker module moves downward.

The first coupling unit and the second coupling unit may be provided with a push latch-type fastening structure fastened when pushed and separated when pushed again.

The bracket may include a first bracket coupled to the rear surface of the body, a second bracket protruding from an upper portion of the first bracket, and a third bracket protruding from the second bracket and positioned at a back of the speaker module, wherein the one end of each of the upper links may be fastened to the third bracket.

The sound apparatus may further include a motor to rotate at least one of the upper links to vertically move the speaker module.

The sound apparatus may further include a drive gear to rotate about a hinge coupled portion of the one end of each of the upper links, wherein the motor may rotate the drive gear.

The sound apparatus may further include a worm coupled to a shaft of the motor to rotate, a worm wheel engaged with the worm to rotate and adapted to transmit power to the drive gear.

The shaft of the motor may disposed perpendicular to the drive gear, and the worm wheel is coupled to the bracket such that a rotation axis of the worm wheel is parallel with a rotation axis the drive gear.

The sound apparatus may further include a connection gear interposed between the worm wheel and the drive gear to transmit rotational force of the worm wheel to the drive gear.

The sound apparatus may further include a first switch turned on when the speaker module is positioned at an upper portion, and a second switch turned on when the speaker module is positioned at a lower portion, wherein operation of the motor may be stopped when the first switch or the second switch is turned on.

The middle frame may be integrated with both the upper links and the lower links.

The body may include a display unit.

The sound apparatus may further include a tilting structure to adjust an angle between the body and the speaker module.

The at least one speaker module may include a plurality of speaker modules, wherein the number of speaker modules moving to a lower end may vary depending upon a kind of output sound.

In another aspect of the present invention, a sound apparatus provided with a speaker vertically movable at a lower side includes a body, a bracket coupled to a lower end of a rear surface of the body and provided with a vertical slot formed in a vertical direction, a speaker module provided, at an upper portion thereof, with a moving protrusion inserted into the vertical slot, the speaker module vertically moving according to movement of the moving protrusion along the vertical slot, a middle frame including an inclined slot, the moving protrusion being inserted into the inclined slot, and a drive unit to laterally move the middle frame, wherein, when the middle frame is laterally moved, the moving protrusion vertically moves along the vertical slot according to lateral movement of the inclined slot to vertically move the speaker module.

The drive unit may include a rack gear formed at the middle frame in a horizontal direction, and a pinion gear engaged with the rack gear to rotate, wherein the rack gear is laterally moved according to rotation of the pinion gear to laterally move the middle frame.

The drive unit may further include a motor to provide rotational force, a screw-shaped worm rotating according to rotation of the motor, a worm wheel engaged with the worm to rotate about a shaft of the motor arranged in a vertical direction, the worm rotating the pinion gear.

The sound apparatus may further include a connection gear arranged between the worm wheel and the pinion gear.

The middle frame may further include a horizontal slot, wherein the bracket is further provided with a guide protrusion inserted into the horizontal slot.

A length of the horizontal slot may be equal to or greater than a horizontal length of the inclined slot.

A height of the inclined slot may correspond to a length of the vertical slot.

According to at least one embodiment of the present invention, design of the front is enhanced by allowing the speaker module to be exposed forward only when needed, lateral twist or rocking of the speaker module may be minimized during movement of the speaker module.

Since the speaker module moves to the lower side of the body 310, lateral arrangement of an additional space for the speaker is not needed. Accordingly, space utilization may be enhanced.

The effects obtainable from the present invention are not limited to the aforementioned effects. Other effects which are not mentioned above may be clear to those skilled in the art from the descriptions given below.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

The present invention may have various modifications and embodiments. Specific embodiments are exemplarily shown in the accompanying drawings and a detailed description thereof will be given below. However, the present invention is not limited to the illustrated embodiments. It should be understood that the present invention covers all modifications, equivalents, or substitutes within the spirit and scope of the present invention.

Terms including ordinal numbers such as first, second, etc. may be used to explain various components, but the constituents are not limited thereto. These terms are used only for the purpose of distinguishing one constituent from another.

When one constituent is said to be "connected" or "linked" to another, it should be understood that this means the one constituent may be directly connected or linked to another or another constituent may be interposed between the constituents. On the other hand, when one constituent is mentioned as being "directly connected" or "directly linked" to another, it should be understood that this means no other constituent is interposed between the constituents.

Terms used in this specification are merely adopted to explain specific embodiments, and are not intended to limit the present invention. A singular expression includes a plural expression unless context indicates otherwise. In this specification, "include" or "have" is intended to indicate that characteristics, figures, steps, operations, constituents, and components disclosed in the specification or combinations thereof exists. "Include" or "have" should be understood as not precluding existence of one or more other characteristics, figures, steps, operations, constituents, components, combinations thereof, or possibility of addition thereof.

Reference will now be made in detail to the preferred embodiments of the present invention, examples of which are illustrated in the accompanying drawings. Wherever possible, the same reference numbers will be used throughout the drawings to refer to the same or like parts.

Figure 1:
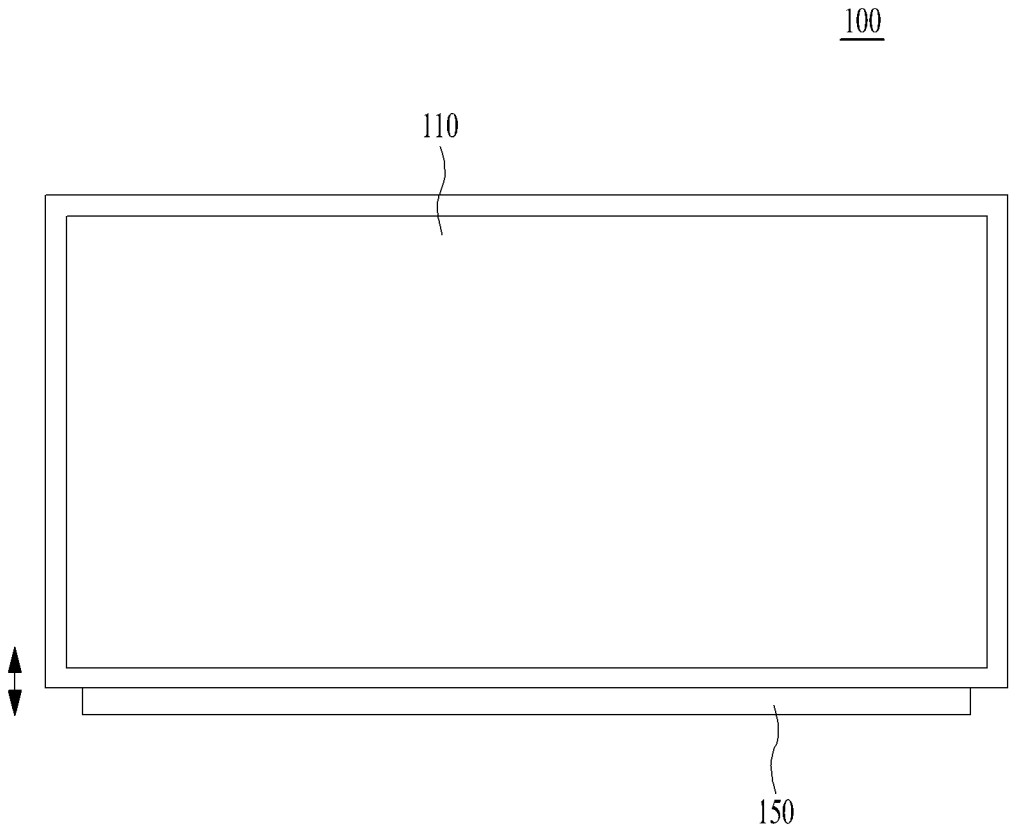
FIG. 1 is a front view illustrating a sound apparatus according to an exemplary embodiment of the present invention.

FIG. 1 is a front view illustrating a sound apparatus 100 according to an exemplary embodiment of the present invention. A display apparatus may be an example of the sound apparatus 100. When the display apparatus is in use, a speaker module 150 moves to the lower portion of the body 110, at which a display unit is positioned and exposed at the front, as shown in FIG. 1. When the display apparatus is not in use, the speaker module 150 moves to the upper portion of the body 110 and is thus positioned on the rear surface of the body 110 so as not to be exposed at the front.

Figure 2:
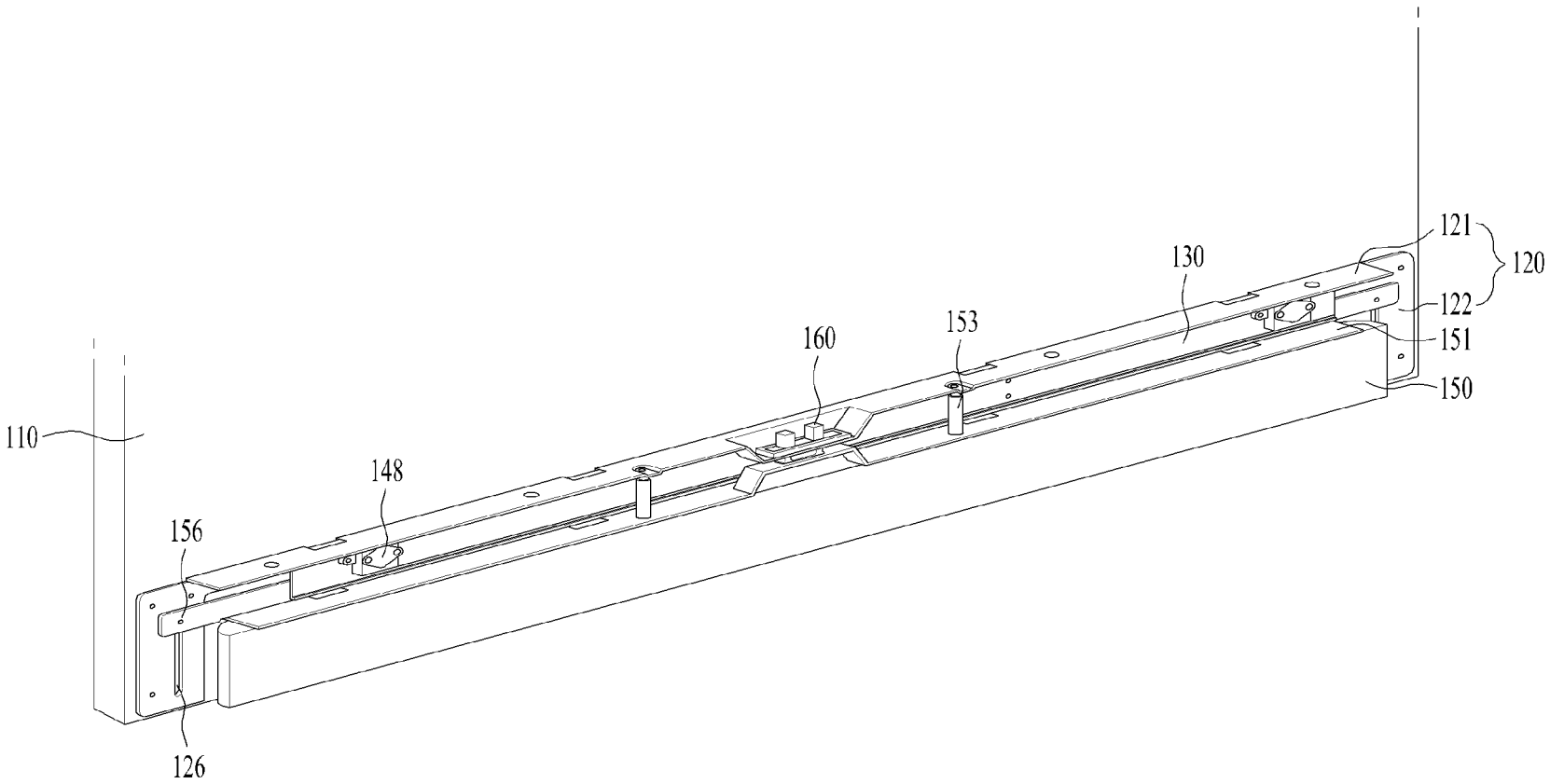
FIG. 2 is a rear view illustrating a speaker module of a sound apparatus positioned at an upper portion according to one embodiment.
Figure 3:
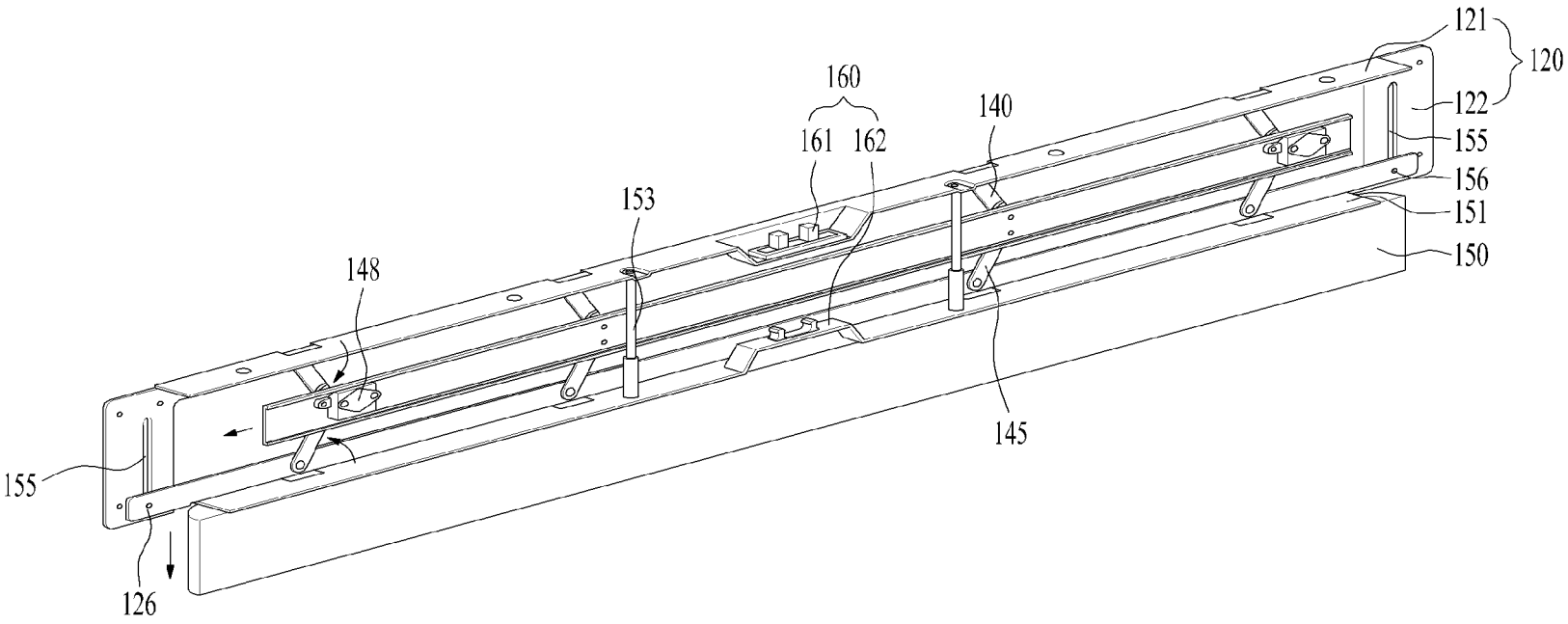
FIG. 3 is a rear view illustrating a speaker module of a sound apparatus positioned at a lower portion according to one embodiment.

A detailed description will be given of a stricture allowing vertical movement of the speaker module 150 with reference to FIGS. 2 to 6. FIG. 2 is a rear view illustrating a speaker module 150 of a sound apparatus 100 positioned at an upper portion according to one embodiment of the present invention, and FIG. 3 is a rear view illustrating the speaker module 150 of the sound apparatus 100 positioned at a lower portion.

The sound apparatus 100 of this embodiment is a display apparatus. The sound apparatus 100 includes a body 110, a bracket 120, an upper link 140, a lower link 145, a middle frame 130, and a speaker module 150.

The upper link 140, the lower link 145, and the middle frame 130 are positioned between the body 110 and the speaker module 150. When the upper link 140 and the lower link 145 rotate from the positions shown in FIG. 2, the body 110 and the speaker module 150 move away from each other, and thus the speaker module 150 moves to the lower side of the body 110. At this time, the middle frame 130 moves in a lateral direction according to rotation of the upper link 140 and the lower link 145.

In the display apparatus, a display unit and a circuit part to control the speaker module 150 and the display unit are positioned at the body 110, at which components of the sound apparatus 100 other than the speaker module 150 are installed.

As the importance of the design of the front surface of the display apparatus 100 increases, bezel size has decreased to minimize exposure of portions other than the display unit through the front surface, and the speaker is disposed so as not to be exposed through the front surface. In this embodiment, the speaker module 150 moves vertically to be exposed through the front surface only when in use.

The bracket 120 is coupled to the lower portion of the rear surface of the body 110, and is fastened to the speaker module 150 such that the speaker module 150 is coupled to the body 110. The components (the upper link 140, the lower link 145, the middle frame 130, and the speaker frame 151) to vertically move the speaker module 150 are positioned between the bracket 120 and the speaker module 150. The bracket 120 may be formed of a rigid material such as SUS since it needs to support weight of the speaker module 150.

The speaker module 150, which serves to convert a sound signal into sound and outputs sound, uses a diaphragm, a magnet and a coil. When current according to the sound signal flows through the coil placed in the magnetic field of the magnet, mechanical force is applied to the coil according to the current, causing the diaphragm to move back and forth to produce sound.

While a speaker module 150 is exemplarily illustrated in FIGS. 2 and 3 as being arranged at the lower end of the body 110, two or more speaker modules 150 may be provided to output stereo sound. The plural speaker module 150 may individually move up and down.

Herein, the number and kind of speakers of each speaker module may vary depending upon the kind of output sound. For example, only two speakers may be moved to the lower end and used as two-channel speakers in the case that a high quality of sound is not required as in viewing news, while more speakers may be used to form four or more-channel speakers when music is appreciated. In addition, the speaker module 150 may include a woofer. Thereby, 4.1 channel or 5.1 channel speakers may be implemented using the woofer.

One end of the upper link 140 is hinge-coupled to the bracket 120, and the other end thereof is coupled to the middle frame 130. One end of the lower link 145 is coupled to the middle frame 130, and the other end thereof is coupled to the speaker module 150. To couple the lower link to the speaker module 150, a speaker frame 151 may be provided to the upper end of the speaker module 150.

A tilting structure (not shown) may be arranged between the speaker module 150 and the speaker frame 151. When the speaker module 150 is moved down to the lower portion, the tilting structure may be tilted forward, rearward, leftward, or rightward between the speaker frame 151 and the speaker module 150 to adjust the angle formed between the speaker module 150 and the body 110.

For example, in the case that the display apparatus 100 is positioned at the upper side, the tilting structure may be tilted such that the speaker module 150 leans rearward with respect to the body 110. In addition, in the case that three or more speaker modules 150 are provided, the left and right speakers may be tilted toward the center. Optimum sound may be implemented through the tilting structure.

A plurality of upper links 140 and a plurality of lower links 145 may be provided. Middle frames 130 interposed between the upper links 140 and the lower links 145 may be provided for the links, or a long middle frame 130 connected to the links may be used as shown in FIG. 2. If there is a difference in the degree of rotation between the links, the speaker module 150 may tilt as it moves. Accordingly, the middle frame 130 connected to the entire links guides the links such that the links rotate to the same degree.

Figure 4:
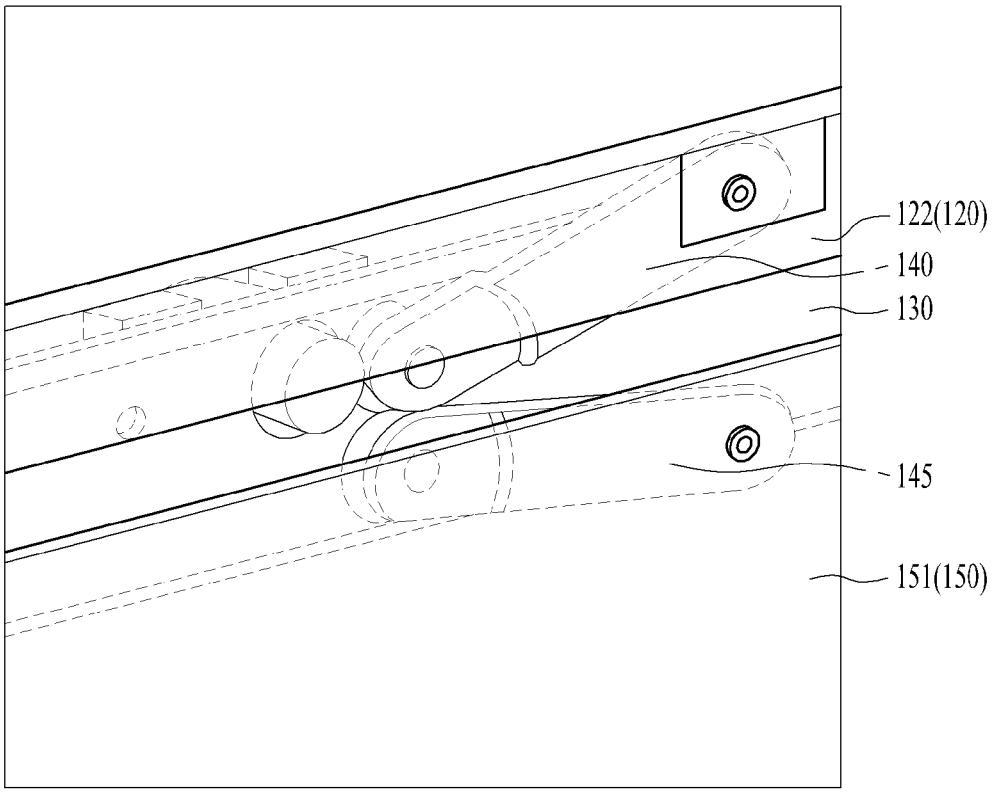
FIGS. 4 and 5 are perspective views illustrating an upper link and a lower link hinge-coupled to a middle frame of a sound apparatus according to one embodiment.
Figure 5:
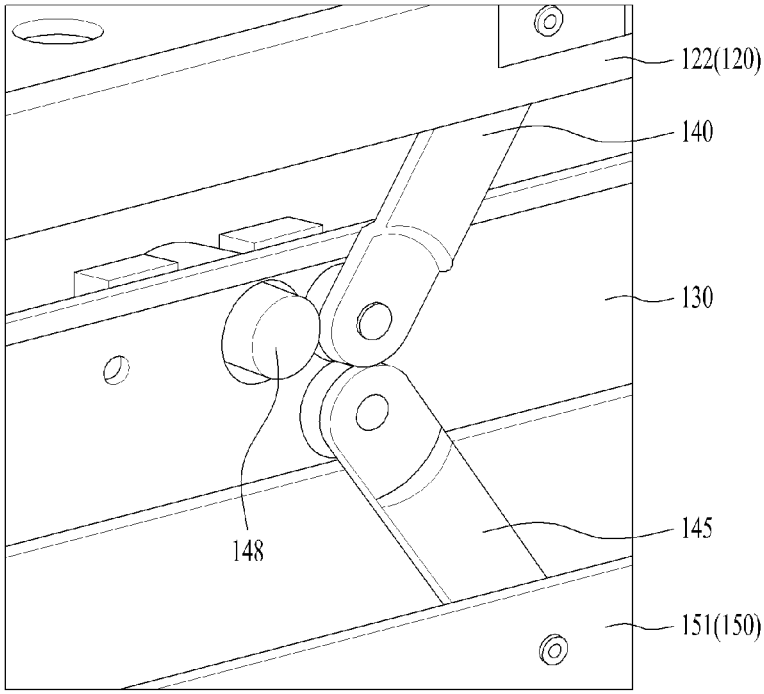

FIGS. 4 and 5 are perspective views illustrating an upper link 140 and a lower link 145 hinge-coupled to a middle frame 130 of a sound apparatus 100 according to one embodiment. In the case that the speaker module 150 is positioned at the upper portion, the upper link 140 and the lower link 145 are laterally disposed as shown in FIG. 4. In the case that the speaker module 150 is positioned at the lower portion, the upper link 140 and the lower link 145 rotate as an angle therebetween increases, and the middle frame 130 moves laterally as shown in FIG. 5. At this time, the direction of rotation of the upper link 140 is opposite to that of the lower link 145.

The other end of the upper link 140 and the one end of the lower link 145 may be coupled to the middle frame 130 while being spaced apart from each other, or may be coupled to the middle frame 130 to be adjacent to each other in order to contact each other when they rotate, as shown in FIGS. 4 and 5.

To adjust the rotational speed, a damper 148 may be provided to the other end of the upper link 140 or the one end of the lower link 145. The damper 148 is a member to reduce rotational speed using frictional force. As shown in FIG. 4, the damper 148 is arranged to contact the other end of the upper link 140 or the one end of the lower link 145 to prevent the upper link 140 and the lower link 145 from quickly rotating to cause the speaker module 150 to quickly move downward.

A guide may be provided to allow vertical movement of the speaker module 150 during rotation of the upper link 140 and the lower link 145. The guide prevents the speaker module 150 from laterally rocking while moving upward according to rotation of the upper link 140 and the lower link 145.

For example, the guide may be configured, as shown in FIG. 3, with a guide groove 126 vertically formed in the bracket 120, and a guide protrusion 156 protruding from the upper front surface of the speaker module 150 to vertically move along the guide groove 126. The guide groove 126 may be directly formed on the rear surface of the body 110.

As another example of the guide, a guide pole 153 arranged between the bracket 120 and the speaker module 150 may be used. The bracket 120 includes a first bracket 121 coupled to the rear surface of the body 110 and a second bracket 122 protruding from the upper end of the bracket 120 toward the rear surface of the body 110. One end of the guide pole 153 is coupled to the second bracket 122, and the other end thereof is coupled to the upper end of the speaker module 150. The length of the guide is varied to control vertical movement of the speaker module 150.

Figure 6:
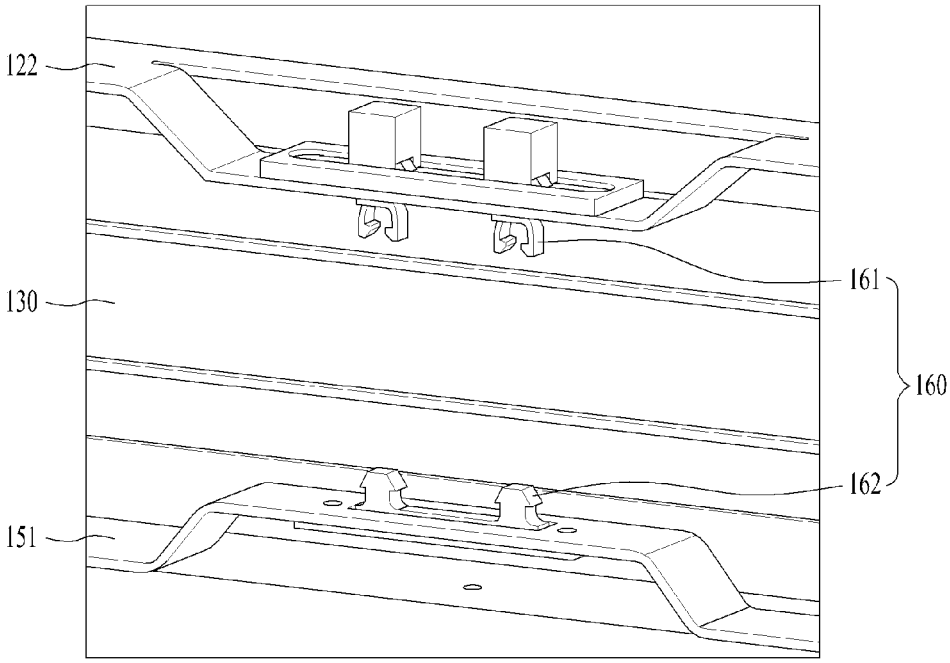
FIG. 6 is a perspective view illustrating a first coupling unit and a second coupling unit of a sound apparatus according to one embodiment.

In this embodiment, a fastening part 160 may be provided to fix the speaker module 150 when the speaker is moved to the upper portion. FIG. 6 is a perspective view illustrating a first coupling unit 161 and a second coupling unit 162 of a sound apparatus 100 according to one embodiment. In FIG. 6, the fastening part 160 is configured with the first coupling unit 161 and the second coupling unit 162.

The first coupling unit 161 is formed on the second bracket 122 to face downward. The second coupling unit 162 is positioned at the upper end of the speaker module 150 such that the second coupling unit 162 is fastened to the first coupling unit 161 when the speaker module 150 moves to the upper portion, and is released from the first coupling unit 161 when the speaker module moves to the lower portion.

As shown in FIG. 6, a push latch-type fastening structure causing the portions to be fastened to and separated from each other by push may be provided. That is, when a user raises and pushes the speaker module 150 to couple the first coupling unit 161 to the second coupling unit 162, the speaker module 150 is fixed to the upper portion. When the user pushes the speaker module 150 again, the push latch-type fastening structure is separated, and the speaker module 150 is lowered by weight of the speaker module 150.

At this time, by controlling the rotational speed of the hinged portions of the upper link 140 and the lower link 145, the speed of lowering of the speaker module 150 is adjusted. The rotational speed of the hinged portions may be adjusted by arranging a gear between the upper link 140 and the lower link 145 or fitting a silicone member between the upper link 140 and the lower link 145 to increase frictional force. The rotational speed may be additionally controlled using the damper 148.

According to this embodiment, the speed of vertical movement of the speaker module 150 is adjusted using the upper link 140 and the lower link 145, and the speaker module 150 is fixed to the upper portion through the fastening part 160. Thereby, the speaker module 150 may be exposed forward only when it is vertically moved at the lower portion of the body 110 for use. In this embodiment, a user manually pushes up the speaker module 150 to cause vertical movement of the speaker module 150 and controls fastening of the fastening part 160.

In the configuration of the illustrated embodiment, vertical movement of the speaker module 250 may be automatically controlled using a motor 260 that controls vertical movement of the speaker module 250. Hereinafter, an embodiment of automatically controlling vertical movement of the speaker module 250 will be described in detail with reference to FIGS. 7 to 14.

Figure 7:
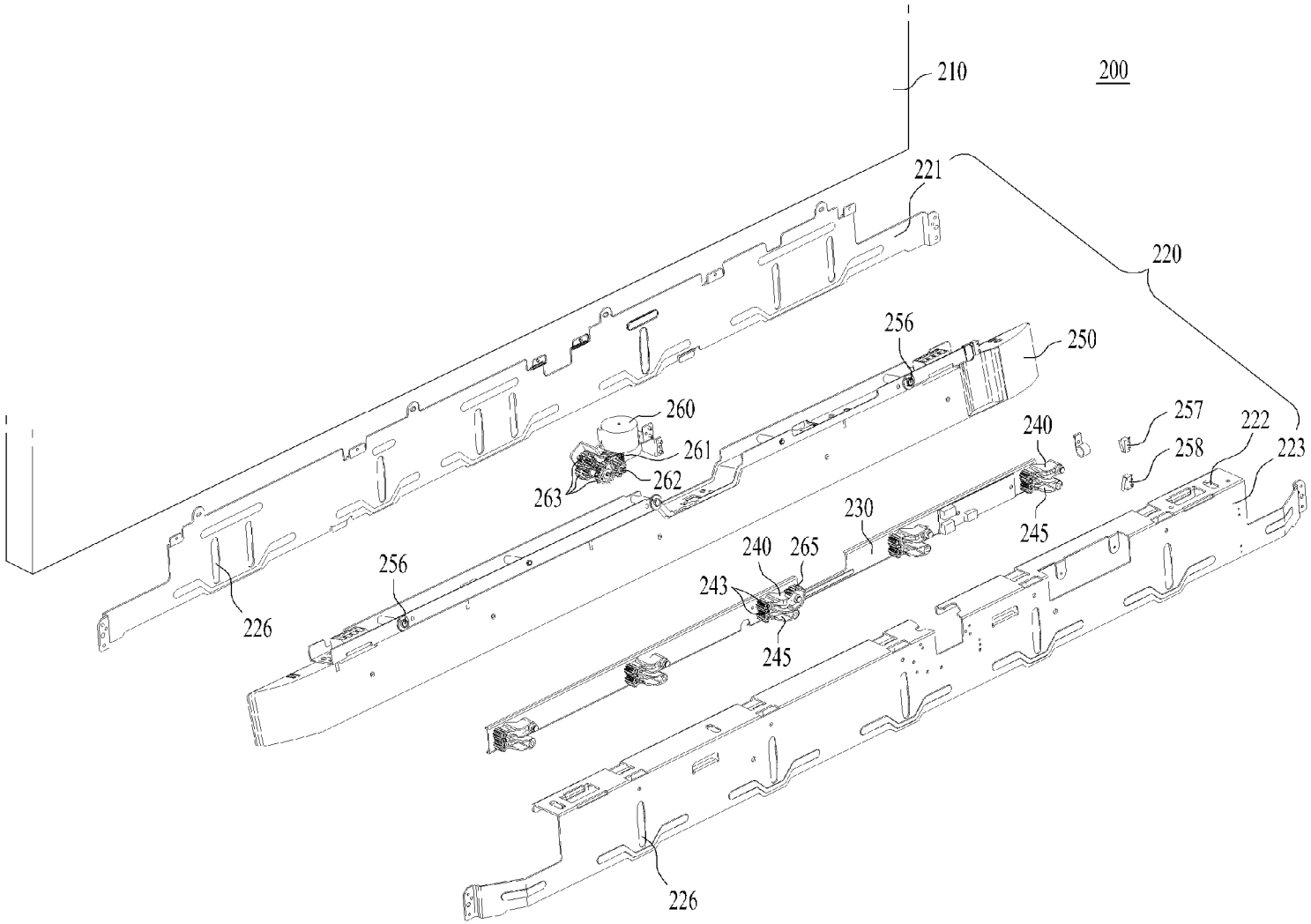
FIG. 7 is an exploded perspective view illustrating a sound apparatus according to another embodiment of the present invention.
Figure 8:
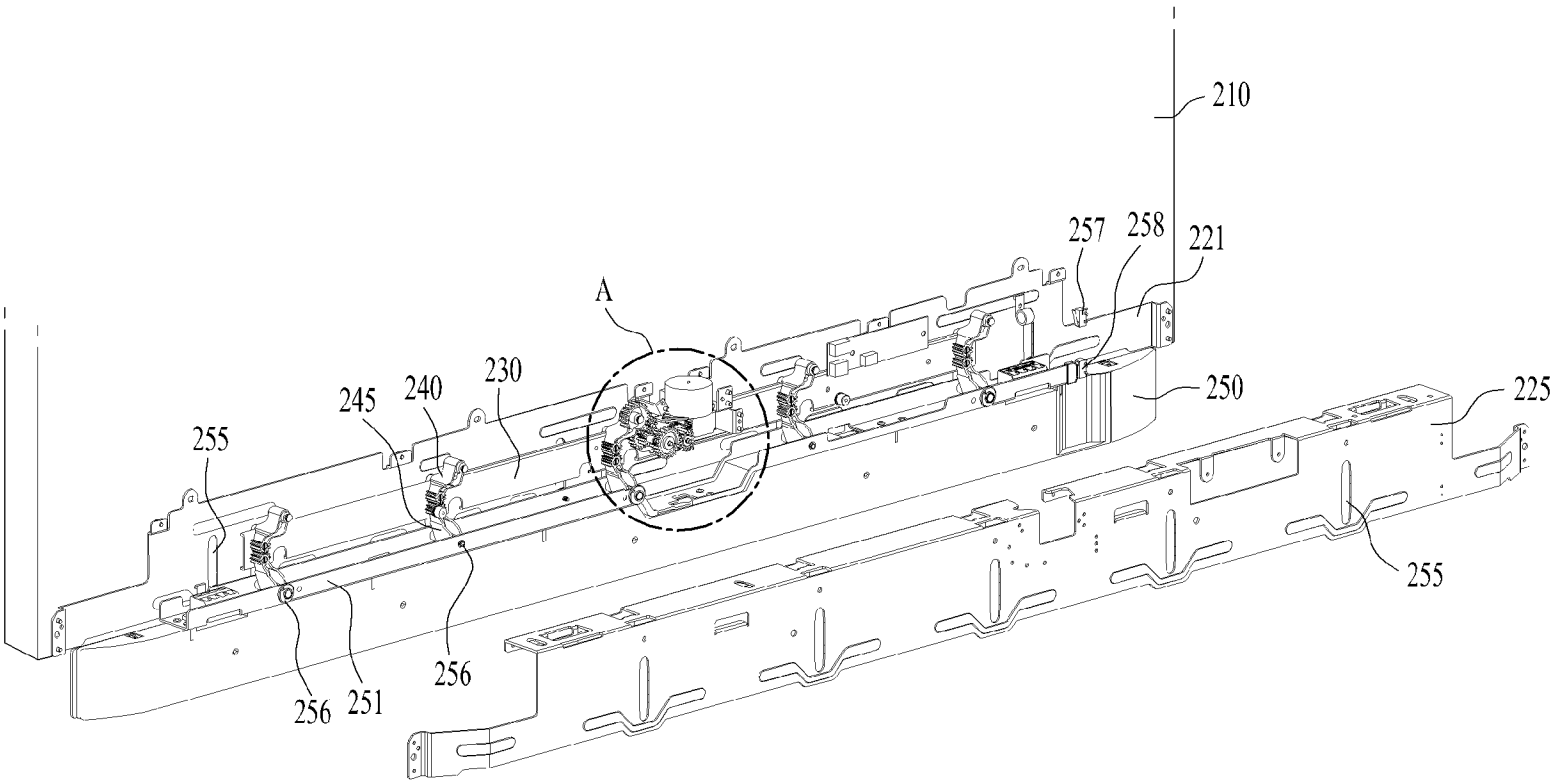
FIG. 8 is a perspective view illustrating a sound apparatus according to another embodiment, which is assembled.

FIG. 7 is an exploded perspective view illustrating a sound apparatus 200 according to another embodiment of the present invention, and FIG. 8 is a perspective view illustrating the sound apparatus 200 according to another embodiment, which is assembled. Referring to FIGS. 7 and 8, the sound apparatus 200 includes a body 210, a bracket 220, an upper link 240, a lower link 245, a speaker module 250 and a motor 260.

A display unit and a circuit part to control the speaker module 250 and the display unit are positioned at the body 210, at which components of the sound apparatus 100 other than the speaker module 250 are installed.

The bracket 220 is coupled to the lower portion of the rear surface of the body 210 and connected to the speaker module 250 through the upper link 240 and the lower link 245 such that the speaker module 250 is vertically movable with respect to the body 210. In this embodiment, the bracket 220 includes a first bracket 221, which is coupled to the rear surface of the body 210, a second bracket 222 protruding from the upper end of the first bracket 221 toward the rear surface of the body 210 and a third bracket 223 provided to the second bracket 222 and positioned on the rear surface of the speaker module 250.

The first bracket 221 is coupled to the rear surface of the body 210. The second bracket 222 connects the third bracket 223, which covers the back of the speaker module 250 to the first bracket 221, and covers the upper portion of the speaker module 250. The third bracket 223 prevents the speaker module 250 from being exposed outside by covering the back of the speaker module 250. In this embodiment, one end of the upper link 240 is coupled to the third bracket 223.

As in the previous embodiment, both ends of the upper link 240 are hinge-coupled to the bracket 220 and the middle frame 230, while both ends of the lower link 245 are hinge-coupled to the middle frame 230 and the speaker module 250. The upper portion of the speaker module 250 may be provided with a speaker frame 251 to be fastened to the lower link 245, the speaker frame 251 may be formed in a bracket shape by being bent upward from the front and rear surfaces of the speaker module 250. A hinge shaft hinge-coupled to the other end of the lower link 245 may be provided in the bracket-shaped speaker frame 251.

According to this embodiment, the speaker module 250 is vertically moved by rotation of the upper link 240, which is controlled by the motor 260. Accordingly, by providing a hinge gear 243 between the other end of the upper link 240 and the one end of the lower link 245 such that the lower link 245 rotates according to the rotational speed of the upper link 240, the rotational speed of the upper link 240 and the lower link 245 may be kept constant.

Figure 9:
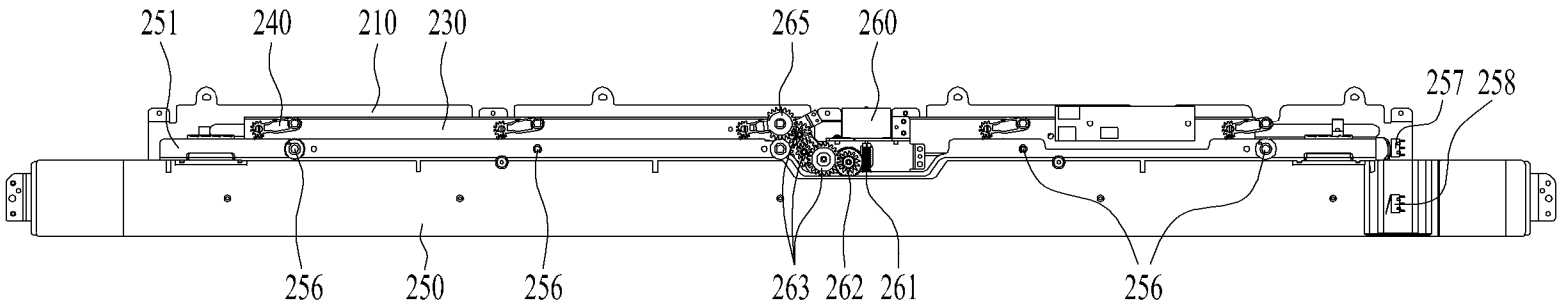
FIG. 9 is a rear view illustrating a speaker module of a sound apparatus positioned at an upper portion according to another embodiment, in which a third bracket is omitted.
Figure 10:
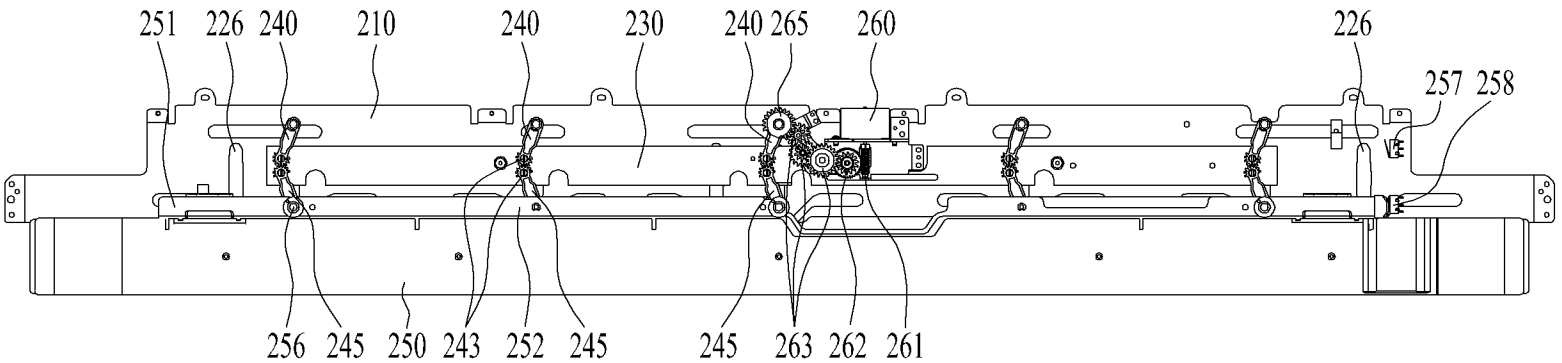
FIG. 10 is a rear view illustrating the speaker module of the sound apparatus positioned at a lower portion according to another embodiment, in which a third bracket is omitted.

FIG. 9 is a rear view illustrating a speaker module 250 of a sound apparatus 200 positioned at an upper portion according to another embodiment, in which the third bracket 223 is omitted, and FIG. 10 is a rear view illustrating the speaker module 250 positioned at a lower portion, in which the third bracket 223 is omitted.

In FIG. 9, the lower link 245 covered by the speaker module 250 is not shown. The upper link 240 and the lower link 245 are arranged in the lateral direction such that one end of the upper link 240 is adjacent to the other end of the lower link 245.

In this case, the angle between the upper link 240 and the lower link 245 increase as the links rotate in the opposite directions. The speaker module 250 moves downward when the middle frame 230 moves in the lateral direction, as shown in FIG. 10.

Figure 11:
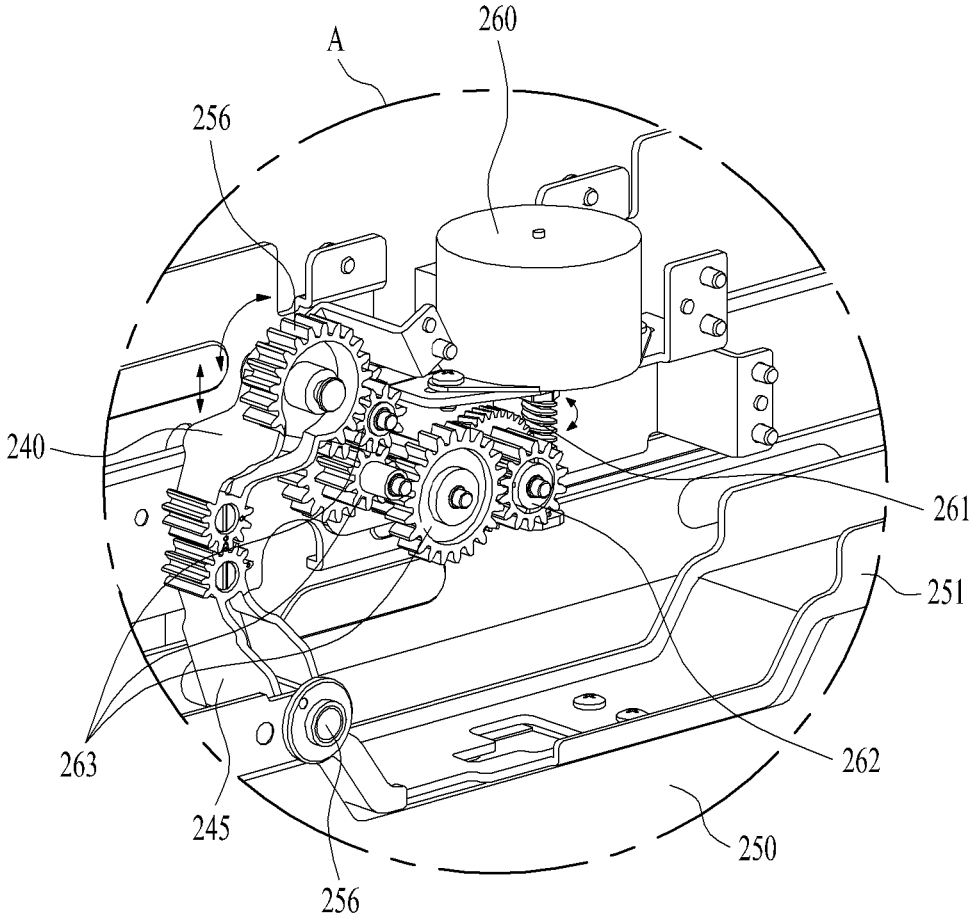
FIG. 11 is an enlarged view illustrating portion A of FIG. 8.

In the illustrated embodiment, rotation of the upper link 240 is controlled by the motor 260. FIG. 11, which is a partially enlarged view of the motor 260 of FIG. 8, shows the motor 260, the upper link 240, and gears 261, 262, 263 and 265 positioned between the motor 260 and the upper link 240.

The motor 260 rotates about an axis of rotation when electricity is applied thereto. The rotating part of the motor 260 may serve as a hinge shaft hinge-coupled to one end of the upper link 240 to control the rotational speed of the upper link 240. In this case, however, the shaft of the motor 260 is disposed in the front-back direction, resulting in increase of thickness of the structure.

Therefore, in order not to increase the thickness of the structure coupled to the back of the body 210 to allow vertical movement of the speaker module 250, the shaft of the motor 260 may be disposed in a direction perpendicular to the direction of arrangement of the hinge-coupling axle of the upper link 240. The shaft of the motor 260 may be disposed to face downward as shown in FIG. 11, or may be disposed to face in the upward direction or lateral direction.

Since the shaft of the motor 260 is perpendicular to the hinge-coupling axle of the upper link 240, a worm 261 and a worm wheel 262 are provided to transmit rotational force of the motor 260 from the motor 260 to the hinge at one end of the upper link 240. The worm 261, which is a screw-shaped gear, is fitted to the rotating part of the motor 260 such that it rotates. The threads of the worm 261 are engaged with the teeth of the worm wheel 262. Accordingly, when the motor 260 rotates, the worm wheel 262 also rotates. Using the worm 261 and the worm wheel 262, the shaft may be arranged at the right angle.

The hinge-coupled portion of one end of the upper link 240 is provided with a drive gear 265. The drive gear 265 is rotated by rotational force transmitted from the motor 260 to control rotation of the upper link 240. Herein, the worm wheel 262 and the drive gear 265 coupled to the upper end of the upper link 240 are not positioned in the same plane, and the worm wheel 262 is spaced apart from the drive gear 265, as shown in FIG. 11. Accordingly, at least one connection gear 263 may be interposed between the worm wheel 262 and the drive gear 265 to transmit rotational force of the worm wheel 262.

The drive gear 265 only needs to be provided to one of a plurality of upper links 240. As shown in FIG. 10, when one of the upper links 240 rotates, the other upper links 240 are also rotated by the middle frame 230 at the same speed as the upper link 240 provided with the drive gear 265. Accordingly, the vertical movement of the speaker module 250 may be controlled by one motor 260, rather than by plural motors 260.

Since the rotational speed of the upper link 240 is controlled according to the rotational speed of the motor 260, the speaker module 250 may be prevented from falling at high speed and allowed to vertically move at a constant speed.

Switches 257 and 258 may be provided to control operation of the motor 260 such that the motor 260 does not operate any more once movement of the speaker module 250 is completed. FIGS. 9 and 10 show a first switch 257 and a second switch 258. The first switch 257 is pushed and turned on by the speaker module 250 when the speaker module 250 is positioned at an upper portion. The second switch 258 is pushed and turned on by the speaker module 250 when the speaker module 250 is positioned at a lower portion.

When the user turn on the sound apparatus 200 using a remote control to lower the speaker module 250, the motor 260 is driven and the first switch 257 pushed by the speaker module 250 switches from the ON state to OFF state at it is released from the pushing force. In addition, the speaker module 250 moves downward and pushes the second switch 258 to be switched from OFF state to ON state, as shown in FIG. 10. When the second switch 258 is turned on, operation of the motor 260 is stopped.

On the other hand, when electricity applied to the sound apparatus 200 is cut off, the motor 260 operates to move the speaker module 250 positioned at the lower portion to an upper portion. Thereby, the speaker module 250 begins to move upward. Once the second switch 258 is turned off and upward movement of the speaker module 250 is completed, the first switch 257 is pushed and turned on by the speaker module 250, and operation of the motor 260 is stopped.

Figure 12:
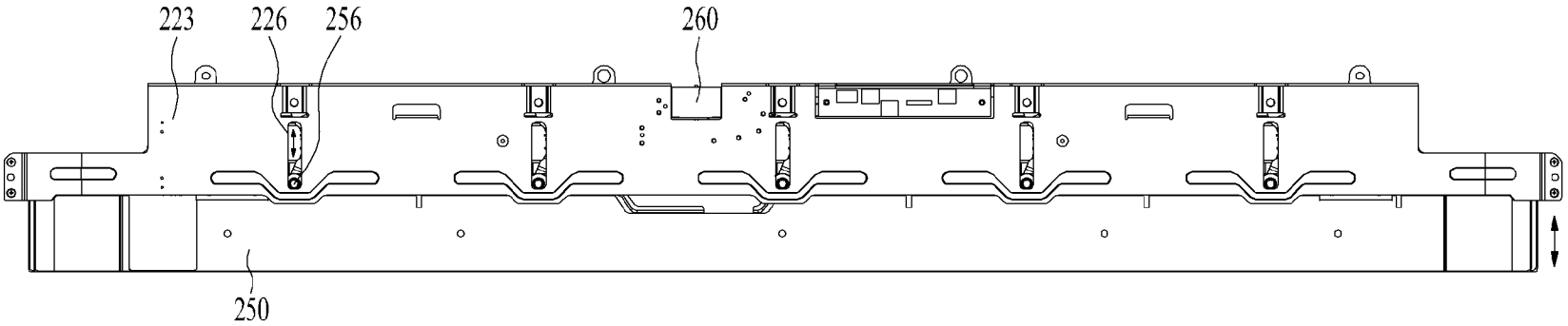
FIG. 12 is a rear view illustrating a speaker module of a sound apparatus positioned at a lower portion according to another embodiment.

FIG. 12 is a rear view illustrating the speaker module 250 positioned at a lower portion, in which the third bracket 223 covers the back of the speaker module 250. Referring to FIG. 12, a guide groove 226 is shown, and a guide protrusion 256 protruding from the speaker module 250 is inserted into the guide groove 226 to guide the speaker module 250 such that the speaker module 250 moves vertically without rocking laterally.

Referring to FIG. 7, the guide protrusion 256 may function as a hinge shaft of the lower link 245 coupled to the speaker module 250. As shown in FIG. 7, the guide groove 226, vertically extending a long distance, may be formed in both the first bracket 221 and the third bracket 223, and the guide protrusion 256 may be formed on both front and rear surfaces of an upper portion of the speaker module 250.

Figure 13:
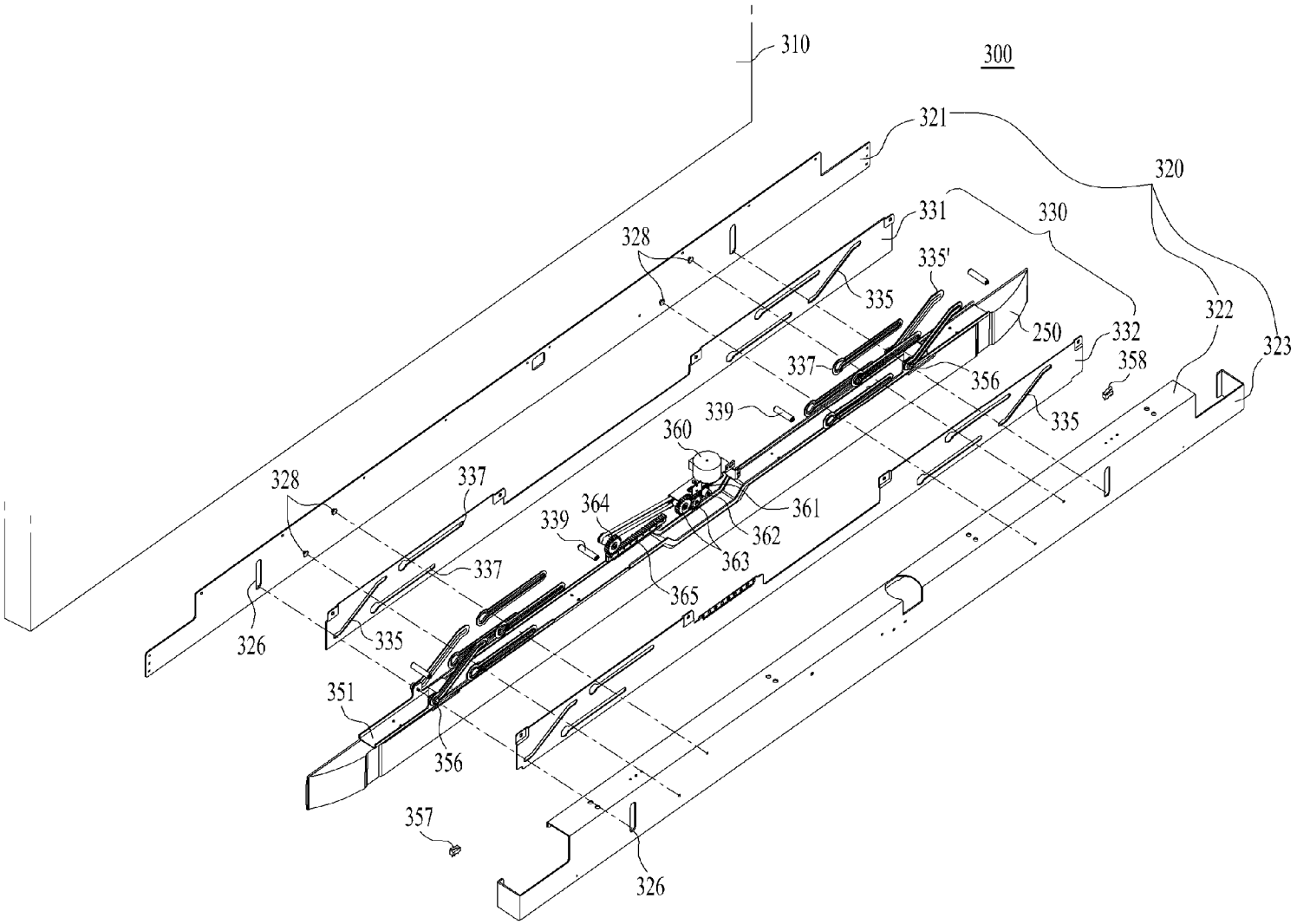
FIG. 13 is an exploded perspective view illustrating a sound apparatus according to another embodiment.
Figure 14:
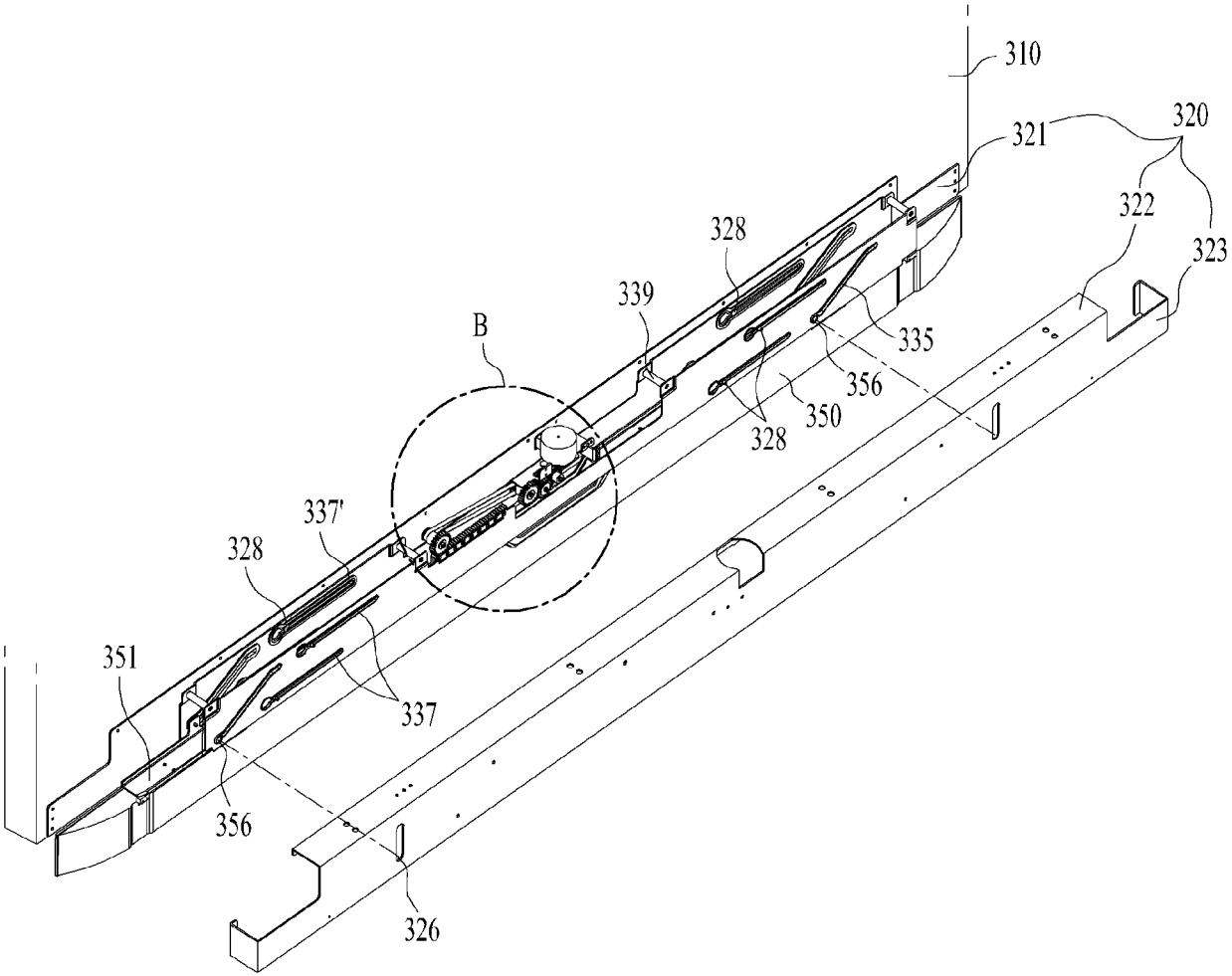
FIG. 14 is a perspective view illustrating a sound apparatus according to another embodiment, which is assembled.

FIG. 13 is an exploded perspective view illustrating a sound apparatus 300 according to another embodiment, and FIG. 14 is a perspective view illustrating the sound apparatus 300, which is assembled. Referring to FIGS. 13 and 14, the sound apparatus 300 includes a body 310, a bracket 320, a middle frame 330, a speaker module 350, and a motor 360.

A display unit and a circuit part to control the speaker module 350 and the display unit are positioned at the body 310, at which components of the sound apparatus 300 other than the speaker module 350 are installed.

The bracket 320 is coupled to the lower portion of the rear surface of the body 310. In this embodiment, the bracket 320 includes a first bracket 321, which is coupled to the rear surface of the body 310, a second bracket 322 protruding from the upper end of the first bracket 321 toward the rear surface of the body 310, and a third bracket 323 provided to the second bracket 322 and positioned on the back of the speaker module 350.

The bracket 320 includes a vertical slot 326. A moving protrusion 356 protruding from the speaker module 350 is inserted into the vertical slot 326. The moving protrusion 356 vertically moves along the vertical slot 326 to vertically move the speaker module 350.

The vertical slot 326 only needs to be formed in any one of the first bracket 321, which is coupled to the back of the body 310, and the third bracket 323, which is positioned on the back of the speaker module 350. Preferably, the vertical slot 326 is formed in both the first bracket 321 and the second bracket 322, as shown in FIGS. 13 and 14, to ensure that the speaker module 350 stably moves vertically without rocking.

As described in a previous embodiment, the speaker module 350 is positioned on the back of the body 310 when it is not vertically moved at the lower end of the body 310, and is exposed at the lower portion of the body 310 when it is in use. When the moving protrusion 356 protruding from the upper portion of the speaker module 350 moves along the vertical slot 326 of the bracket 320 as discussed above, the speaker module 350 also vertically moves.

A speaker frame 351 may be further provided to the upper portion of the speaker module 350, and the moving protrusion 356 may be formed at the speaker frame 351. The speaker frame and the moving protrusion 356 may be made of a rigid material such as metal or reinforced plastics in order that they are not damaged when subjected to weight of the speaker.

In this embodiment, the middle frame 330 having an inclined slot 335 is used to apply force to a guide pole to vertically move the moving protrusion 356 along the vertical slot 326. The moving protrusion 356 is inserted into the inclined slot 335. When the middle frame 330 moves in a horizontal direction, the moving protrusion 356 moves along the inclined slot 335.

Figure 15:
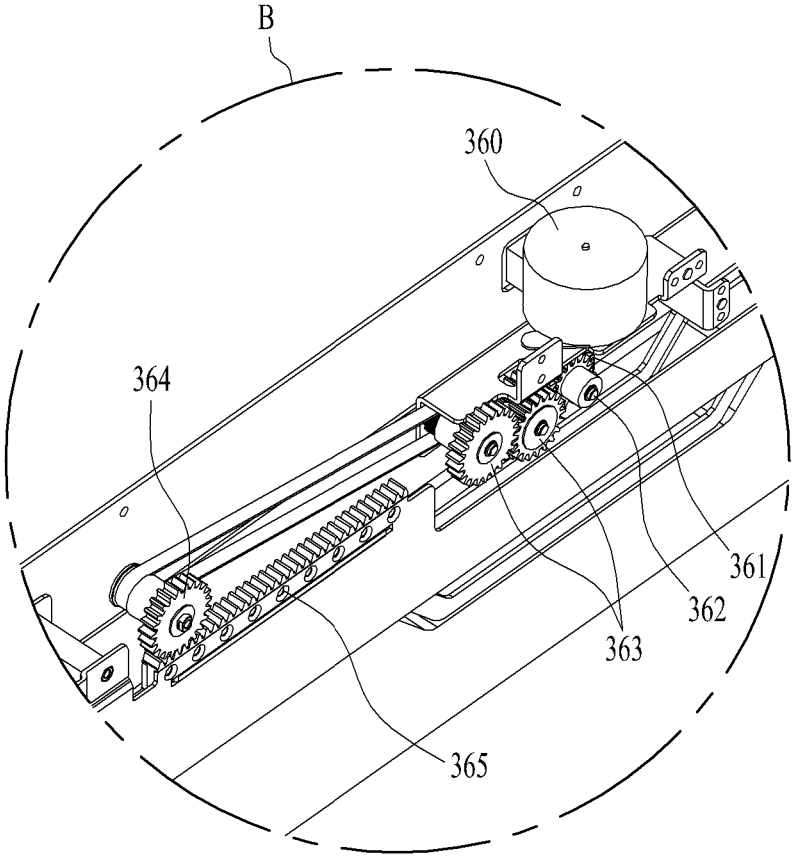
FIG. 15 is a rear view illustrating a speaker module of a sound apparatus positioned at an upper portion according to another embodiment.

The pattern of movement of the moving protrusion 356 along the inclined slot 335 and the vertical slot 326 will be described in more detail with reference to FIGS. 15 and 16. FIG. 15 is a rear view illustrating a speaker module 350 of a sound apparatus 300 positioned at an upper portion and a drive unit according to another embodiment, and FIG. 16 is a rear view illustrating the speaker module 350 of a sound apparatus 300 positioned at a lower portion.

In this embodiment, the inclined slot 335 is inclined to rise up as it extends from the left to the right in the figures. The inclined slot 335 may be arranged in the opposite manner. The moving protrusion 356 is inserted into the inclined slot 335 and the vertical slot 326, along which the protrusion moves.

Figure 16:
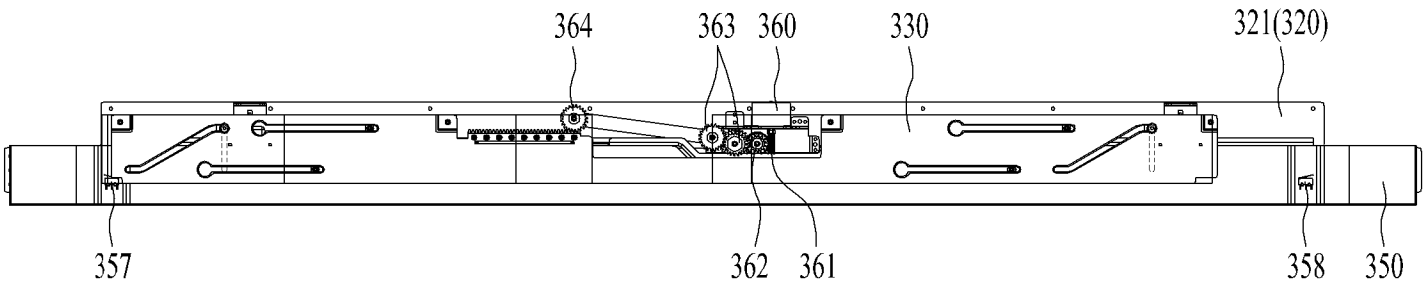
FIG. 16 is a rear view illustrating a speaker module of a sound apparatus positioned at a lower portion according to another embodiment.

When the middle frame 330 moves from the position shown in FIG. 15 to the right side and reaches the position shown in FIG. 16, the moving protrusion 356 is positioned at the upper end of the inclined slot 335 in the case that the speaker module 350 is positioned at an upper portion, and is positioned at the lower end of the inclined slot 335 in the case that the speaker module 350 is positioned at a lower portion. According to movement of the middle frame 330, the moving protrusion 356 moves along the inclined slot 335.

In this embodiment, the middle frame serves to directly transmit force through the motor. Accordingly, two middle frames 331 and 332 may be used to stably support load. The two middle frames 331 and 332 are coupled to each other through a fastening member 339. Thereby, when force is applied to one middle frame 332 of the two middle frames, the other middle frame 331 moves together.

Since the moving protrusion 356 moves along the inclined slot 335, it may be seen to move upward and laterally. However, horizontal movement is conducted by the middle frame 330, and thus the moving protrusion 356 actually moves only in the vertical direction. The vertical movement of the moving protrusion 356 is made along the vertical slot 326 formed in the bracket 320.

The middle frame 330 may further include a horizontal slot 337 to ensure that the middle frame 330 stably move without vertically moving during in lateral movement. A guide protrusion 328 protruding from the bracket 320 is inserted into the horizontal slot 337. Thereby, the middle frame 330 moves only in the horizontal direction relative to the bracket 320.

The horizontal slot 337 of the first bracket 321 is inserted into the horizontal slot 337 of the front middle frame 331, and a guide protrusion (not shown) of the third bracket 321 is inserted into the horizontal slot 337 of the rear middle frame 332. Thereby, horizontal movement of the middle frame 330 is guided.

When the middle frame 330 horizontally moves, the inclined slot 335 moves. Accordingly, the moving protrusion 356 is subjected to force in a vertical direction during movement along the inclined slot 335, and thus vertically moves along the vertical slot 326, causing the speaker module 350 to vertically move.

Since the moving protrusion 356 and the guide protrusion 328 subjected to load acting downward are inserted into moved along the inclined slot 335 and the horizontal slot 326 formed in the middle frame 330, the slots may be worn and deformed. To prevent this, reinforcement slots 335' and 337' are attached to the inclined slot 335 and the horizontal slot 326 to assist the inclined slot 335 and the horizontal slot 326.

Figure 17:
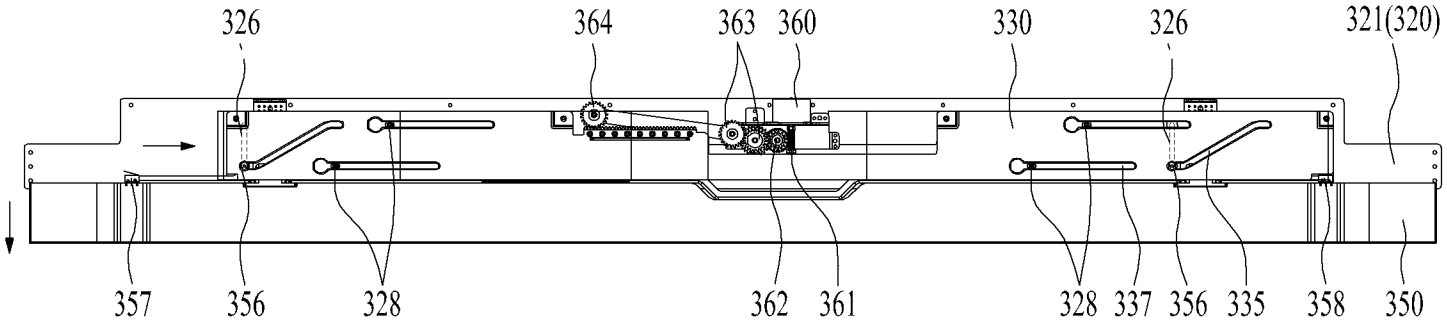
FIG. 17 is an enlarged view illustrating portion B of FIG. 13.

FIG. 17 is an enlarged perspective view of the motor 360. The motor 360 is a device to apply driving force to the middle frame 330. A rack gear 365 and a pinion gear 364 may be used to apply rotational force to cause the middle frame 330 to linearly move. The rack gear 365 is a linear gear with teeth, and the pinion gear 364 is a disc-shaped gear with teeth engaged with those of the rack gear 365.

To apply rotational force to the pinion gear 364, the motor 360 may be provided with a worm 361 and a worm wheel 362, as in the previous embodiment. The worm 361 and the worm wheel 362 converts rotation about the shaft of the motor 360, which is vertically disposed, into rotation about a shaft arranged in a horizontal direction (see FIGS. 15 and 16).

That is, when the motor 360 rotates, the worm 361 rotates, and accordingly the worm wheel 362 engaged with the worm 361 also rotates. A connection gear 363 may be used to transmit the rotational force of the worm wheel 362 to the pinion gear 364. When the pinion gear 364 rotates, the rack gear 365 moves in a horizontal direction, and the middle frame 330 laterally moves. In FIG. 15, the pinion gear 364 is positioned on the right side of the rack gear 365. In FIG. 16, the pinion gear 364 is positioned on the left side of the rack gear 365. That is, the rack gear 365 laterally moves according to rotation of the pinion gear 364, and the middle frame 330 in turn laterally moves.

When the user turns on/off the sound apparatus 300, the motor 360 may start to operate. Once movement of the speaker module 350 to the lower end or upper end is completed, operation of the motor 360 is stopped. In the case that movement of the speaker module 350 to the lower end is completed, a first switch 357 is turned on. In the case that movement of the speaker module 350 to the upper end is completed, a second switch 358 is turned on. Thereby, operation of the motor 360 is stopped. While the switches 257 and 258 of the previous embodiment are disposed at positioned where they are pushed by the vertically moving speaker module 250, the switches 357 and 358 of this embodiment are disposed on the left and right sides of the middle frame 330 such that the middle frame 330 pushes the switches 357 and 358.

That is, in the case that movement of the speaker module 350 to an upper portion is completed as shown in FIG. 15, the middle frame 330 moves to the left side, pushing the first switch 357 to stop operation of the motor 360. On the other hand, in the case that movement of the speaker module 350 to an lower portion is completed as shown in FIG. 16, the middle frame 330 moves to the right side, pushing the second switch 358 to stop operation of the motor 360.

As discussed above, according to at least one embodiment of the present invention, design of the front is enhanced by allowing the speaker module to be exposed forward only when needed, lateral twist or rocking of the speaker module may be minimized during movement of the speaker module.

Since the speaker module moves to the lower side of the body 310, lateral arrangement of an additional space for the speaker is not needed. Accordingly, space utilization may be enhanced.

It will be apparent to those skilled in the art that various modifications and variations can be made in the present invention without departing from the spirit or scope of the inventions.

Therefore, the detailed described given above should be understood as being illustrative rather than limiting in all aspects. The scope of the invention should be determined by reasonable interpretation of the appended claims, and the present invention covers the modifications and variations of this invention provided they come within the scope of the appended claims and their equivalents.

What is claimed is:

1. A sound apparatus provided with a speaker vertically movable at a lower side comprising:

a body;

a bracket coupled to a lower portion of a rear surface of the body;

a plurality of upper links, one end of each of the upper links being hinge-coupled to the bracket;

a middle frame hinge-coupled to the other end of each of the upper links;

a plurality of lower links, one end of each of the lower links being hinge-coupled to the middle frame; and at least one speaker module hinge-coupled to the other end of each of the lower links to vertically move according to rotational movement of the upper links and the lower links, wherein a direction of rotation of the upper links is opposite to a direction of rotation of the lower links, and the middle frame moves in a lateral direction during the rotational movement of the upper links and the lower links.

2. The sound apparatus according to claim 1, further comprising a first hinge gear coupled to the other end of each of the upper links and a second hinge gear coupled to the one end of each of the lower links, the first hinge gear and the second hinge gear rotating in engagement with each other during rotation of the upper links and the lower links.

3. The sound apparatus according to claim 1, further comprising a damper adjoining at least one end of each of the upper links or the lower links to apply frictional force to reduce a rotational speed of the upper links and the lower links.

4. The sound apparatus according to claim 1, further comprising a guide to guide linear movement of the speaker module when the speaker module vertically moves.

5. The sound apparatus according to claim 4, wherein the bracket comprises a first bracket coupled to the rear surface of the body, and a second bracket protruding from an upper end of the first bracket toward the rear surface of the body, wherein the guide is a guide pole placed between the second bracket and an upper end of the speaker module, a length of the guide pole being variable.

6. The sound apparatus according to claim 4, wherein the guide comprises:

a vertical guide groove formed in the rear surface of the body or the bracket; and a guide protrusion protruding from an upper portion of the speaker module, the guide protrusion being inserted into the guide groove to move when the speaker module vertically moves.

7. The sound apparatus according to claim 1, wherein the bracket comprises a first bracket coupled to the rear surface of the body, a second bracket protruding from an upper end of the first bracket, and a third bracket protruding from the second bracket and positioned at a back of the speaker module, wherein the one end of each of the upper links is fastened to the third bracket.

8. The sound apparatus according to claim 1, further comprising a motor to rotate at least one of the upper links to vertically move the speaker module.

9. The sound apparatus according to claim 8, further comprising a drive gear to rotate about a hinge coupled portion of the one end of each of the upper links, wherein the motor rotates the drive gear.

10. The sound apparatus according to claim 8, further comprising:

a worm coupled to a shaft of the motor to rotate;

a worm wheel engaged with the worm to rotate and adapted to transmit power to the drive gear.

11. The sound apparatus according to claim 10, wherein:

the shaft of the motor is disposed perpendicular to the drive gear; and the worm wheel is coupled to the bracket such that a rotation axis of the worm wheel is parallel with a rotation axis the drive gear.

12. The sound apparatus according to claim 10, further comprising a connection gear interposed between the worm wheel and the drive gear to transmit rotational force of the worm wheel to the drive gear.

13. The sound apparatus according to claim 8, further comprising a first switch turned on when the speaker module is positioned at an upper portion; and a second switch turned on when the speaker module is positioned at a lower portion, wherein operation of the motor is stopped when the first switch or the second switch is turned on.

14. The sound apparatus according to claim 1, wherein the middle frame is integrated with both the upper links and the lower links.

15. The sound apparatus according to claim 1, wherein the body comprises a display unit.

16. The sound apparatus according to claim 1, further comprising a tilting structure to adjust an angle between the body and the speaker module.

17. The sound apparatus according to claim 1, wherein the at least one speaker module includes a plurality of speaker modules, wherein the number of speaker modules moving to a lower end varies depending upon a kind of output sound.

* * * * *